United States Patent [19]

Mailliet et al.

[11] Patent Number: 4,796,869

[45] Date of Patent: Jan. 10, 1989

[54] SUSPENSION AND ANCHORAGE DEVICE FOR A RAIL-MOUNTED MOVABLE PLUGGING MACHINE FOR METALLURGICAL FURNACES

[75] Inventors: Pierre Mailliet, Howald; Jean Metz, Luxembourg, both of Luxembourg

[73] Assignee: Paul Wurth S.A., Luxembourg, Luxembourg

[21] Appl. No.: 95,568

[22] Filed: Sep. 11, 1987

[30] Foreign Application Priority Data

Sep. 30, 1986 [LU] Luxembourg ..... 86612

[51] Int. Cl.[4] ..... C21B 7/12

[52] U.S. Cl. ..... 266/271

[58] Field of Search ..... 266/271, 272, 273

[56] References Cited

U.S. PATENT DOCUMENTS

| | | | |
|---|---|---|---|
| 1,676,530 | 7/1928 | Dewar | 266/272 |
| 1,688,327 | 10/1928 | Brosius | 266/271 |
| 3,507,484 | 4/1970 | Honda | 266/271 |
| 3,667,748 | 6/1972 | Dienenthal et al. | 266/271 |

*Primary Examiner*—L. Dewayne Rutledge
*Assistant Examiner*—S. Kastler
*Attorney, Agent, or Firm*—Fishman, Dionne & Cantor

[57] ABSTRACT

A suspension and anchoring device for a rail mounted plugging and drilling machine for use in conjunction with metallurgical furnaces is presented. The suspension and anchoring device comprises a cradle mounted on rails which is movable by means of a parallelogram shaped guide bar system actuated by an operating cylinder which shifts the plugging and drilling device between a work position and a travel position.

6 Claims, 1 Drawing Sheet

SUSPENSION AND ANCHORAGE DEVICE FOR A RAIL-MOUNTED MOVABLE PLUGGING MACHINE FOR METALLURGICAL FURNACES

BACKGROUND OF THE INVENTION

This invention relates to a suspension and anchoring device for a rail-mounted movable plugging machine used in conjunction with metallurgical furnaces. More particularly, this invention relates to a plugging machine which is suspended on a cradle mounted on rails and which is movable by means of a parallelogram shaped guide bar system actuated by an operating cylinder, for shifting the plugging machine between a work position and a travel position.

It is well known that certain types of metallurgical furnaces (e.g., hearth-type furnaces with rotary hearths, electric furnaces, blast furnaces with a number of tapholes, etc.), use a plugging machine/drilling machine combination movable upon rails. Such a device can easily and simply service tapholes, or alternatively, in the case of a rotary hearth, the device can follow the hearth. This obviates the otherwise existing necessity of having to assign each individual taphole a drilling machine and a plugging machine, which would be very unfavorable in terms of both expenditure and space requirements.

The known devices comprise the combination of both a plugging machine and a drilling machine mounted on a jointed cradle or crab, the crab either being able to move on floor rails in the region surrounding the furnace, or else hang on overhead rails. The latter solution is much more favorable in terms of space since in this case the tapping platform remains substantially clear for the operating staff. However, a general problem arises in the case of both types of this machine combination movable on rails as a result of the significant forces which have a retroactive effect on the cradle and the rails, particularly during the plugging operation. It will be appreciated that these forces act particularly unfavorably on the hanging arrangement because of the considerable difficulty of imparting the necessary strength and rigidity to an above-floor runway without excessive expenditure.

SUMMARY OF THE INVENTION

The above discussed and other problems and deficiencies of the prior art are overcome or alleviated by the suspension and anchoring device for a rail mounted plugging and drilling machine of the Present invention. In accordance with the present invention, a suspension and anchoring device is provided comprising a crab or cradle mounted on rails which is movable by means of a parallelogram shaped guide bar system actuated by an operating cylinder which shifts the plugging and drilling device between a work position and a travel position.

An important feature of the suspension and anchoring device of the present invention is that the retroactive forces on the plugging machine during the plugging operation are kept away from the cradle and its rail runway to the greatest possible extent.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
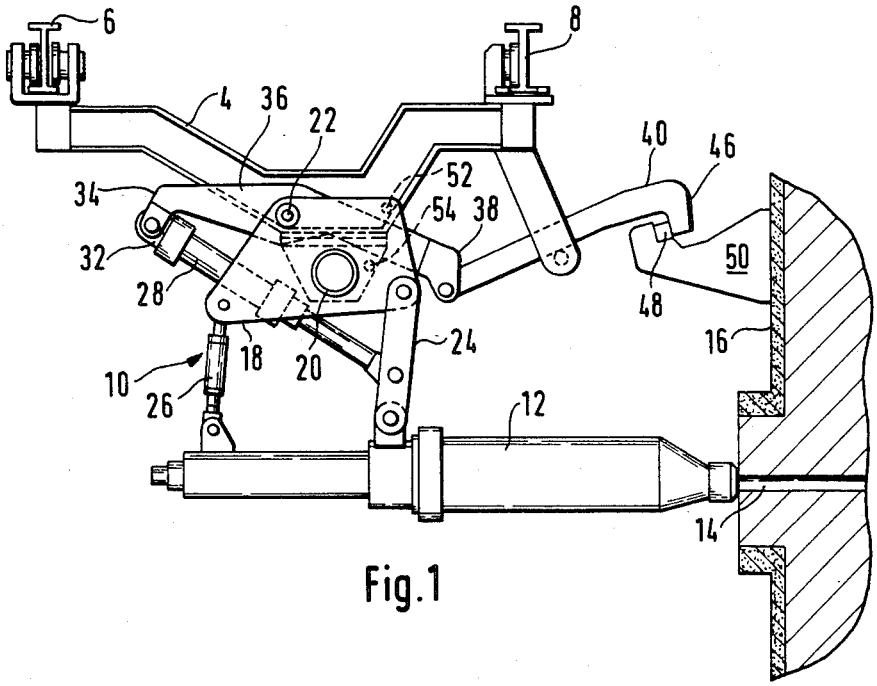
FIG. 1 is a side elevation view of a suspension and anchoring device with a plugging gun in a work position and activated anchorage in accordance with the present invention.

FIG. 1 shows a crab or cradle 4 which is movably suspended on two suspended rails 6 and 8. Suspended on crab 4 is a drilling machine (not shown), and a plugging machine 12. Plugging machine 12 as suspended on crab 4 by means of a parallelogram guide tar system 10. Plugging machine 12 is shown in FIG. 1 in its work position during the plugging of a taphole 14 on a metallurgical furnace 16. Parallelogram guide bar system 10 is formed by plugging machine 12, a suspension apron 18 and two guide bars or link plates 24 and 26 (by means of which plugging machine 12 is pivotably suspended on suspension apron 18). Link plate 26 preferably has a longitudinally adjustable configuration, such as a turnbuckle which makes it possible to set the desired inclination of the plugging machine axis. In FIG. 1, for the sake of simplicity, this inclination of the plugging machine axis towards the horizontal is represented as zero, corresponding to taphole 14 (which is also represented horizontally for the sake of simplicity). Apron 18 is fixed (for example, by means of a main bolt 20 and a secondary bolt 22) so as not to rotate to crab 4.

Figure 2:
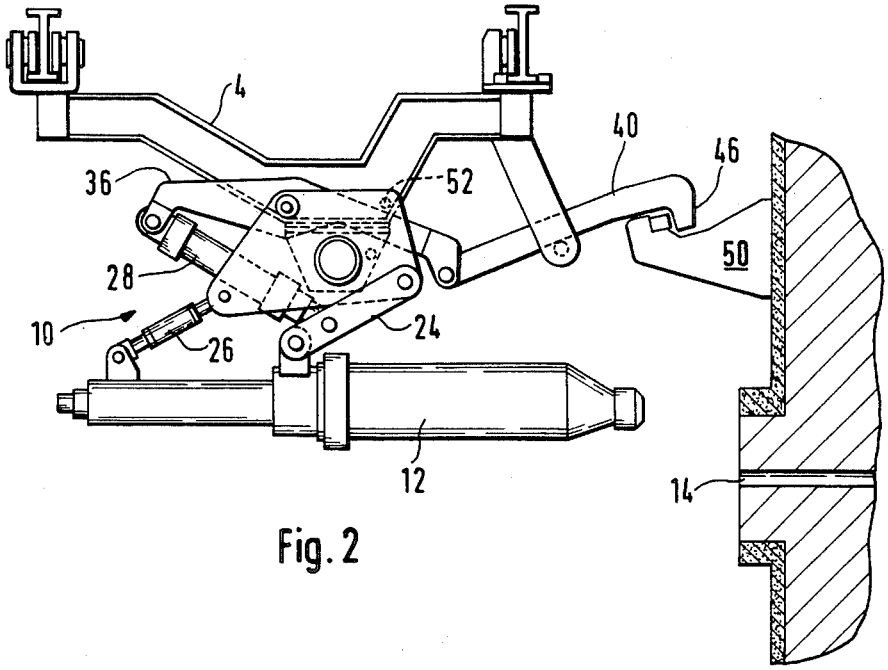
FIG. 2 is a side elevation view of the device of FIG. 1 with the plugging gun in a travel position and released anchorage.

The pivoting movement of plugging machine 12 is effected by actuation of an operating cylinder 28, which is articulated by one end to link plate 24 and by its other end 32 to a first end 34 of a two-armed Lever 36, which is pivotably mounted to a secondary bolt 22. This is in distinct contrast to the prior art wherein an analogous operating cylinder would be articulated to a fixed point of suspension apron 18 or to crab 4. Articulated to the second end 38 of Lever 36 is an anchorage hook 40 which, in its rest position, is in the travel position of the plugging machine (see FIG. 2), and rests on a pin 42. Pin 42 is provided at the end of an arm 44 fastened to crab 4. Hook 40 terminates at a free bent section 46 and is adapted to interact with a stop 48 on an anchorage block 50. Anchorage block 50 is rigidly fastened to the furnace 16 above each and every taphole 14 thereof. Instead of separate blocks 50, it will be appreciated that it is also possible to provide a rail running around the furnace with, for example, the cross-section of block 50. The pivoting movement of lever 36 is limited by two stops, an upper stop 52 and a lower stop 54; the stops being integral with the suspension apron 18 and/or the crab 4.

When plugging the taphole 14 corresponding to the work position of the plugging machine 12 represented in FIG. 1 (piston rod of the operating cylinder 28 extended), plugging machine 12 has to be pressed with considerable force against furnace 16, whereby corresponding counter-forces are exerted on the plugging machine mouthpiece. If the operating-cylinder end 32 were to be articulated (as is the case of the prior art), at just any fixed point of suspension apron 18 or of crab 4, at which point it would support itself, this would cause crab 4 and rails 6 and 8 to be subjected to very high horizontal forces; as can be seen easily from the general arrangement of the system. Therefore, particularly to ensure the necessary rigidity and strength of the railway, the prior art requires that a considerable technical outlay be expended with corresponding costs. However, in accordance with the device of the present invention, the operating-cylinder end 32 is articulated to the end 34 of the pivotable lever 36, whereby the latter is subjected to a torque and the anchoring hook 40 is shifted substantially to the left until, as shown in FIG. 1, its bent end section 46 comes into effective connection with stop 48. This anchoring of lever 40 to furnace 16 keeps crab 4, and thus also rails 6 and 8, free from the horizontal forces directed towards the left, which are exerted by the furnace on the mouthpiece of plugging machine 12. This can be demonstrated by a static analysis (force diagram) of the forces occuring in the system. Crab 4 and more particularly the suspension, (not shown), of the rail track 6 and 8 can therefore be configured significantly more cheaply and compactly.

Retraction of the piston rod of operating cylinder 28 causes plugging machine 12 to be brought into the travel position (FIG. 2) and now, together with the drilling machine (not shown), suspended on the same crab 4, it can be removed from the region of the taphole and, if necessary, brought into position before another taphole. The hook end 46 is then lifted off stop 48. Lever 40 now rests on bolt 42, while Lever 36 supports itself against stop 52.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Suspension and anchoring device for a rail-mounted movable machine for use in conjunction with metallurgical furnaces, the machines being suspended on cradle means suspended on said rails, said machine being movable by means of a parallelogram configured guide bar system actuated by an operating cylinder for shifting the machine between a work position and a travel position and further comprising:

pivotable lever means provided on said cradle means, said lever means having opposed first and second ends;

an operating cylinder having opposed first and second ends, said operating cylinder being articulated at said first end to link plate means of said parallelogram guide bar system and at said second end to said first end of said pivotable lever means;

anchorage hook means articulated to said second end of said lever means;

means for receiving said anchorage hook means on said metallurgical furnace, said receiving means mating with said hook means;

wherein when said machine is in a work position, said operating cylinder supports itself at said first end such that said lever means pivots in a first direction and said hook means is brought into engagement with said hook receiving means; and wherein when said machine is in a travel position, said operating cylinder supports itself at said first end such that said lever means is pivoted in a second direction and said hook means comes out of engagement with said hook receiving means.

2. Device according to claim 1 wherein said parallelogram guide bar system comprises:

a longitudinally adjustable guide bar;

said machine; and a suspension apron, said suspension apron being rigidly connected to said cradle means.

3. Device according to claim 1 including a suspension apron, said suspension apron being rigidly connected to said cradle means and further including:

two stops on at least one of said cradle means and said suspension apron, said stops serving as a support for said lever means when said machine is in a travel position.

4. Device according to claim 2 including:

two stops on at least one of said cradle means and-said suspension apron, said stops serving as a support for said lever means when said machine is in a travel position.

5. Device according to claim 1 including:

an arm projecting from said cradle means; and a pin through said arm, said pin having a free end, said free end defining a stop and guide for said hook means.

6. Device according to claim 1 wherein:

said hook receiving means comprises anchoring block means.

* * * * *